US005379598A

United States Patent [19]

Mostello

[11] Patent Number: 5,379,598

[45] Date of Patent: Jan. 10, 1995

[54] CRYOGENIC RECTIFICATION PROCESS AND APPARATUS FOR VAPORIZING A PUMPED LIQUID PRODUCT

[75] Inventor: Robert A. Mostello, Somerville, N.J.

[73] Assignee: The BOC Group, Inc., New Providence, N.J.

[21] Appl. No.: 110,742

[22] Filed: Aug. 23, 1993

[51] Int. Cl.[6] ..... F25J 3/02

[52] U.S. Cl. ..... 62/24; 62/38; 62/41

[58] Field of Search ..... 62/24, 38, 41

[56] References Cited

U.S. PATENT DOCUMENTS

| | | | |
|---|---|---|---|
| 2,915,882 | 12/1959 | Schuftan et al. | 62/30 |
| 3,500,651 | 3/1970 | Becker | 62/13 |
| 4,303,428 | 12/1981 | Vandenbussche | 62/13 |
| 4,777,803 | 10/1988 | Erickson | 62/22 |
| 4,817,393 | 4/1989 | Erickson | 62/22 |
| 4,883,518 | 11/1989 | Skolaude et al. | 62/38 |
| 5,082,482 | 1/1992 | Darredeau | 62/24 |
| 5,123,249 | 6/1992 | Buttle | 62/24 |
| 5,157,926 | 10/1992 | Guilleminot | 62/24 |
| 5,228,296 | 7/1993 | Howard | 62/22 |
| 5,251,449 | 10/1993 | Rottmann | 62/41 |
| 5,251,451 | 10/1993 | Xu et al. | 62/41 |
| 5,287,704 | 2/1994 | Rathbone | 62/38 |

OTHER PUBLICATIONS

Scharle, W. J. and K. Wilson, "Oxygen Facilities for Synthetic Fuel Projects," Journal of Engineering for Industry, vol. 103, Nov. 1981, pp.409–417.

*Primary Examiner*—Ronald C. Capossela

*Attorney, Agent, or Firm*—David M. Rosenblum; Larry R. Cassett

[57] ABSTRACT

A low temperature rectification process and apparatus in which a compressed gaseous mixture, for instance, air, is rectified to produce a lower volatility component in liquid form which is then pumped to a delivery pressure. After having been pumped, the lower volatility component is vaporized within a main heat exchanger. In order to effect the vaporization, a stream of the compressed gaseous mixture being cooled in the main heat exchanger is further compressed to form a further compressed stream. In order to minimize thermodynamic irreversibility within the main heat exchanger above a theoretical pinch point temperature thereof a portion of the further compressed stream is removed from the main heat exchanger at or near the theoretical pinch point temperature and then is still further compressed and introduced at a level of the main heat exchanger warmer temperature than the theoretical pinch point temperature. Either the balance of the further compressed stream or some other stream of the compressed gaseous mixture being cooled is removed from the main heat exchanger and is then cooled to a temperature suitable for its rectification without further use of the main heat exchanger. Such removal reduces thermodynamic irreversibility within the main heat exchanger below the theoretical pinch point temperature.

6 Claims, 3 Drawing Sheets

CRYOGENIC RECTIFICATION PROCESS AND APPARATUS FOR VAPORIZING A PUMPED LIQUID PRODUCT

BACKGROUND OF THE INVENTION

The present invention relates to a cryogenic rectification process and apparatus for separating high and low volatility components of a gaseous mixture wherein the mixture is initially compressed and then cooled to a temperature suitable for its rectification. More particularly, the present invention relates to such a process and apparatus in which the low volatility component is pumped to a delivery pressure and then is vaporized within a main heat exchanger used in cooling the mixture. Even more particularly, the present invention relates to such a process and apparatus in which thermodynamic irreversibilities within the main heat exchanger are minimized.

Components of gaseous mixtures having different volatilities are separated from one another by a variety of well-known cryogenic rectification processes. Such processes utilize a main heat exchanger to cool the gaseous mixture to a temperature suitable for rectification alter the gaseous mixture has been compressed. The rectification is carried out in distillation columns incorporating trays or packing (structured or random) to bring liquid and gaseous phases of the mixture into intimate contact and thereby separate the components of the mixture in accordance with their volatilities. In order to avoid the use of a product compressor to produce the lower volatility component at a delivery pressure, the distillation is carried out such that the lower volatility component is produced in liquid form. The lower volatility component in the liquid form is then pumped to the delivery pressure and vaporized within the main heat exchanger.

An important cryogenic rectification process concerns the separation of air. Air contains a lower volatility component, oxygen, and a higher volatility component, nitrogen. In the production of pressurized oxygen gas, a liquid oxygen product of the cryogenic rectification of air is pumped to a delivery pressure and heated by incoming air in a heat exchanger from which it emerges as a pressurized gas. Typically, at least part of the air feed must be pressurized to a much higher pressure than the oxygen in order to provide the appropriate temperature difference in the heat exchange. For instance, when an oxygen product, which amounts to 19–22% of the incoming air by volume percent is pumped to 42.8 bar(a), about 35–40% of the incoming air is compressed to about 74.5 bar(a). This requirement is a result of the non-conformity in the temperature and the heat transferred between the feed air and the product streams in some parts of the main heat exchanger, which affects the warning up of the products and the cooling down of the air. Concurrently, wide temperature differences exist between the air and the product streams in part of the heat exchanger. This is known as thermodynamic irreversibility and increases the energy requirement of the process.

As will be discussed, the present invention provides a process and apparatus for the separation of air in which thermodynamic irreversibilities in the main heat exchanger are minimized. Additionally, the present invention also relates to a method of vaporizing a pumped low volatility product within a main heat exchanger, for instance, components of air, petrochemicals and etc. such that thermodynamic irreversibilities within the main heat exchanger are minimized.

SUMMARY OF THE INVENTION

In one aspect, the present invention relates to a process for separating air and thereby producing a gaseous oxygen product at a delivery pressure. In accordance with this process the air is compressed, heat of compression is removed from the air and the air is subsequently purified. The air is then cooled in a main heat exchanger. Prior to the cooling of the air, at least a portion of the air to be cooled is further compressed to form a further compressed air stream. The heat of compression is removed from the further compressed air stream. At least part of the further compressed air stream is removed from the main heat exchanger at a location of the main heat exchanger at which the further compressed air stream has a temperature in the vicinity of a theoretical pinch point temperature and the at least a portion of the at least part of the further compressed air stream removed from the main heat exchanger is still further compressed to form a first subsidiary air stream. This subsidiary, air stream is introduced back into the main heat exchanger at a level thereof having a warmer temperature than the theoretical pinch point temperature. After reintroduction into the main heat exchanger, the first subsidiary air stream is fully cooled to a temperature suitable for its rectification.

A part of the air to be cooled is removed from the main heat exchanger to form a second subsidiary air stream. The second subsidiary air stream is cooled to the temperature suitable for its rectification without the use of the main heat exchanger. The second subsidiary air stream is cooled by expanding the second subsidiary air stream with the performance of expansion work such that the second subsidiary air stream has the temperature suitable for the rectification of the air contained therein. At least part of the work of expansion is applied to the further compression of the at least portion of the at least part of the further compressed air stream removed from the heat exchanger.

The air within the first and second subsidiary air streams is rectified within an air separation unit configured such that liquid oxygen is produced. Refrigeration is supplied to the process to maintain energy balance of the process. A liquid oxygen stream, composed essentially of oxygen, is removed from the air separation unit and is pumped to the delivery pressure. The liquid oxygen stream is vaporized in the main heat exchanger such that it is fully warmed to ambient temperature and the liquid oxygen stream is extracted from the main heat exchanger as a gaseous oxygen product.

As is known in the art, the pinch point temperature represents a temperature within the main heat exchanger where there exists a minimum difference in temperature between all the streams to be cooled in the main heat exchanger versus all the streams to be warmed in the main heat exchanger. Above and below this pinch point temperature, temperature differences and enthalpies diverge to evidence the thermodynamic irreversibility present within the main heat exchanger. This thermodynamic irreversibility represents lost work and therefore part of the energy requirements of the plant that are necessary in vaporizing the product oxygen stream. The term "theoretical pinch point temperature" as used herein and in the claims means the pinch point temperature determined for the collective cold stream in the main heat exchanger by for instance, simulation, that would exist if the first and second subsidiary air streams were never formed. In such case, the main heat exchanger would be operating as a prior art heat exchanger in which all of the further compressed air stream were fully cooled within the main heat exchanger. In the prior art case of the main heat exchanger, if the heating and cooling curves were plotted as temperature versus enthalpy, the pinch point temperature and divergence of these curves would be readily apparent. As will be further discussed, when the cooling and heating curves of a main heat exchanger operated in accordance with the present invention are compared with the prior art case, it can be seen that there is less divergence between the curves and therefore less lost work involved in vaporizing the pumped liquid oxygen stream. More specifically, it can be seen that the first subsidiary air stream is lowering thermodynamic irreversibility between the theoretical pinch point temperature and the temperature at which the first subsidiary air stream is reintroduced into the main heat exchanger and that the withdrawal of the second subsidiary air stream and cooling it without the use of the main heat exchanger is lowering thermodynamic irreversibility below the theoretical pinch point temperature.

It should also be noted that the term "main heat exchanger" as used herein and in the claims does not necessarily mean a single, plate fin heat exchanger. A "main heat exchanger," as would be known to those skilled in the art, could be made up of several units working in parallel to cool and warm streams. The use of high and low pressure heat exchangers is conventional in the art. Collectively the units making up the "main heat exchanger" would have a theoretical pinch point temperature. A further point is that the terms "fully cooled" and "fully warmed" as used herein and in the claims mean cooled to rectification temperature and warmed to ambient, respectively. The term "partially" in the context of "partially warmed" or "partially cooled", as used herein and in the claims means warmed or cooled to a temperature between fully warmed and cooled. Lastly, the term "vicinity" as used herein and in the claims with reference to a theoretical pinch point temperature means a temperature within a range of between plus or minus 50° C. from the theoretical pinch point temperature.

As mentioned above, the process in accordance with the present invention is not limited to the separation of air and could be used ha the cryogenic rectification of other industrial products. As such, the present invention in another aspect provides a process for vaporizing a lower volatility product pumped to a delivery pressure after having been separated from a higher volatility product of a compressed gaseous mixture by a cryogenic rectification process utilizing a main heat exchanger. The main heat exchanger is configured to cool the compressed gaseous mixture to a temperature suitable for its rectification. In accordance with this process, prior to the cooling of the compressed gaseous mixture, at least a portion of the compressed gaseous mixture to be cooled is further compressed to form a further compressed stream. The heat of compression is removed from the further compressed stream. At least a portion of the further compressed stream is removed from the main heat exchanger at a location of the main heat exchanger at which said further compressed stream has a temperature in the vicinity of a theoretical pinch point temperature. At least part of the at least a portion of the further compressed stream is still further compressed to form a first subsidiary, stream. The first subsidiary stream is introduced back into the main heat exchanger at a level thereof having a warmer temperature than the theoretical pinch point temperature. After reintroduction into the main heat exchanger, the first subsidiary stream is fully cooled to a temperature suitable for its rectification. Part of the compressed gaseous mixture to be cooled is removed from the main heat exchanger to form a second subsidiary stream. The second subsidiary stream is then cooled to a temperature suitable for its rectification without further use of the main heat exchanger. The second subsidiary stream is cooled by expanding the second subsidiary stream with the performance of expansion work such that its temperature after expansion is at the temperature suitable for its rectification. At least part of the work of expansion is applied to the further compression of the at least a portion of the at least part of the further compressed stream. The lower volatility product is vaporized within the main heat exchanger.

In a still further aspect, the present invention provides an apparatus for producing an oxygen product at a delivery pressure from air. The apparatus comprises a main compressor for compressing the air. A first after-cooler is connected to the compressor for removing heat of compression from the air and an air purification means is connected to the first after-cooler for purifying the air. A high pressure air compressor is connected to the air purification means for further compressing at least a portion of the air to form a further compressed air stream. A second after-cooler is connected to the high pressure air compressor for removing the heat of compression from the compressed air stream. A main heat exchanger is provided. The main heat exchanger has first and second passageways. The first passageway includes first and second sections and the first section thereof is in communication with the second after-cooler such that the compressed air stream flows into the first section of the first passageway. A means is provided for discharging first and second subsidiary air streams composed of the compressed air stream from the first section of the passageway so that at least the first subsidiary stream upon discharge has a temperature in the vicinity of a theoretical pinch point temperature. An inlet is provided at a location of the main heat exchanger having a warmer temperature than the theoretical pinch point temperature for receiving the first subsidiary air stream after the compression thereof. The second section of the first passageway is in communication with the inlet and position such that the first subsidiary air stream is fully cooled within the main heat exchanger. A heat pump compressor is connected between the discharge means of the main heat exchanger and the inlet thereof for compressing the first subsidiary air stream and an expansion means is provided for expanding the second subsidiary air stream with the performance of expansion work. The expansion means is coupled to the heat pump compressor such that at least part of the expansion work drives the heat pump compressor. An air rectification means is connected to the expansion means and the second section of the first passageway of the main heat exchanger for rectifying the air and thereby producing liquid oxygen. A pump is connected to the air rectification means for pumping the liquid oxygen to the delivery pressure and thereby forming a pumped liquid oxygen stream. The pump is connected to the second passageway of the main heat exchanger such that the pumped liquid oxygen stream flows in a countercurrent direction to the compressed air stream within the first passageway and is thereby vaporized to produce the gaseous oxygen product. A refrigeration means is provided for supplying refrigeration to the apparatus such that energy balance thereof is maintained.

BRIEF DESCRIPTION OF THE DRAWINGS

While the specification concludes with claims distinctly pointing out the subject matter that applicant regards as his invention, it is believed that the invention will be better understood when taken in conjunction with the accompanying drawings in which:

DETAILED DESCRIPTION

Figure 1:
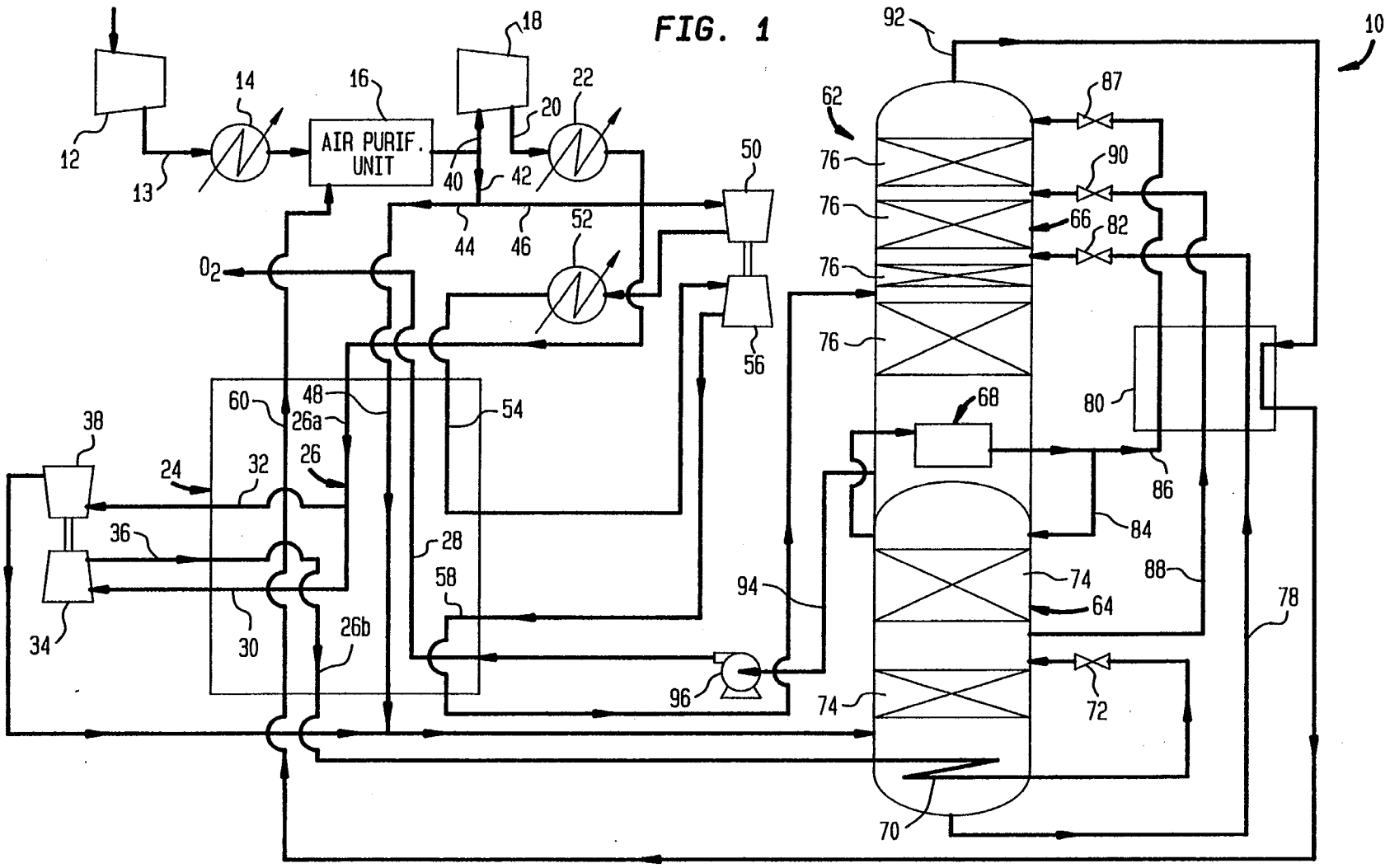
FIG. 1 is a schematic of an air separation plant in accordance with the process and apparatus of the present invention.

With reference to the figure, an air separation plant 10 carrying out a method in accordance with the present invention is illustrated.

The air to be rectified is compressed in a main compressor 12 to form a compressed air stream 13. The heat of compression is removed from compressed air stream 13 by a first after-cooler 14, typically water-cooled, and compressed air stream 13 is then purified by an air pre-purification unit 16 in which carbon dioxide, moisture and hydrocarbons are removed from the air. A high pressure compressor 18 is connected to the air pre-purification unit 16 to form a further compressed air stream 20. After passage through a second after-cooler 22 (to remove heat of compression from the further compressed air stream) further compressed air stream 20 is introduced into a main heat exchanger 24. Main heat exchanger 24 has a first passageway 26 in communication with second after-cooler 22 such that the further compressed air stream 20 flows into first passageway 26 having first and second sections **26*a* and 26*b*. Second passageway 28 is provided for vaporizing a pumped liquid oxygen stream that will be discussed hereinafter. First section 26*a* of first passageway 26 is provided with outlets for discharging first and second subsidiary air streams 30 and 32 from main heat exchanger 24. First subsidiary air stream 30 is still further compressed within a heat pump compressor 34. A still further compressed stream 36 is introduced into main heat exchanger 24 and second section 26*b* of first passageway 26 by a means of an inlet positioned at a level of heat exchanger 24 warmer than the theoretical pinch point temperature. At the same time, second subsidiary, air stream 32 is introduced into a turboexpander 38 that turboexpands second subsidiary air stream 32 sufficiently that it is cooled to a temperature suitable for its rectification without further use of main heat exchanger 24. Turboexpander 38 is coupled to heat pump compressor 34 either mechanically or electro-mechanically by means of a generator coupled to turboexpander 38 and utilized to generate electricity to drive an electric motor coupled to heat pump compressor 34. It is understood that excess energy, above that required to drive heat pump compressor 34, my be produced by turboexpander 38. In such case the excess energy could be applied elsewhere in the plant. For instance, excess electricity generated by the generator coupled to turboexpander 38** could be used for other electrical needs in the plant.

It is removal of the first and second subsidiary air streams and their utilization as described above within compressor 34 and turboexpander 38 coupled to one another, that the thermal irreversibilities of main heat exchanger 24 above and below the theoretical pinch point temperature are minimized. A more detailed discussion of this will be set forth hereinafter.

Although an air separation plant or any other cryogenic rectification process can operate as thus far described, preferably not all of the air is compressed within high pressure air compressor 18 but rather, after air pre-purification unit 16, compressed air stream 13 is divided into first and second partial streams 40 and 42. First partial stream 40 is subjected to further compression within high pressure air compressor 18. Second partial stream 42 is divided into third and fourth subsidiary air streams 44 and 46. Third subsidiary air stream 44 is fully cooled within main heat exchanger 24 within a third passageway 48 provided for such purpose. Fourth subsidiary air stream 46 is further compressed within a refrigeration booster compressor 50 and the heat of compression is removed by way of an after-cooler 52. With heat of compression removed, fourth subsidiary air stream 46 is partially cooled within main heat exchanger 48 by provision of a fourth passageway 54 provided for such purpose. Fourth subsidiary air stream 46 is then withdrawn from main heat exchanger 24 and is passed through a refrigeration turboexpander 56 coupled to refrigeration booster compressor 50. The exhaust of refrigeration turboexpander 56 is then returned to main heat exchanger 24 through a fifth passageway 58. Main heat exchanger 24 is also provided with a sixth passageway 60 for fully warming a waste nitrogen stream (that will be discussed in more detail hereinafter) to ambient temperature and for use in regenerating pre-purification unit 16.

Figure 2:
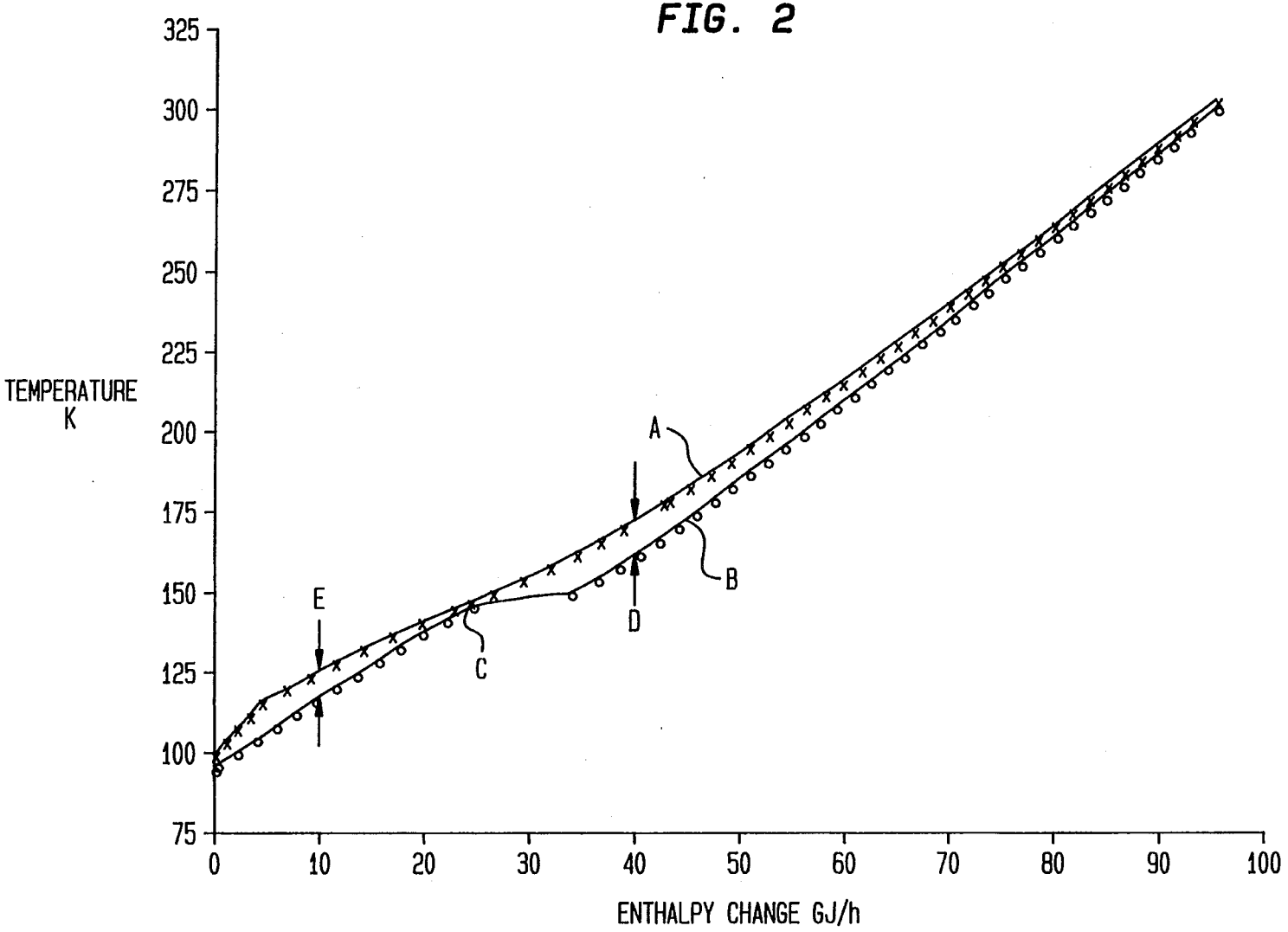
FIG. 2 is a graph of temperature versus enthalpy of a heat exchanger of the prior art.

With reference to FIG. 2, the temperature and enthalpy characteristics of a prior art heat exchanger are plotted. The heat exchanger used in deriving such plot is similar to the heat exchanger described above except that all of the further compressed stream is fully cooled to rectification temperature within the main heat exchanger and none of it is removed to form first and second subsidiary air streams 30 and 32. Curve A is the sum of all of the streams to be cooled in the main heat exchanger; for instance, all the air streams. Curve B represents the sum of the enthalpy and temperatures at discrete points within the main heat exchanger of the streams to be warmed; for instance, the pressurized oxygen and waste nitrogen streams. In order for there to be heat transfer between the hot and cold streams, there must be a temperature difference between the streams at any point in the main heat exchanger. The streams undergoing cooling must have a higher temperature than the streams being warmed. A point is reached though, where there is a minimum temperature difference, namely a pinch point temperature C. The distance between the curves, for instance distance D above the pinch point temperature and distance E below the pinch point temperature are indicative of the thermodynamic irreversibilities inherent within such a main heat exchanger. This thermodynamic irreversibility represents lost work, which translates into extra work of compression.

Figure 3:
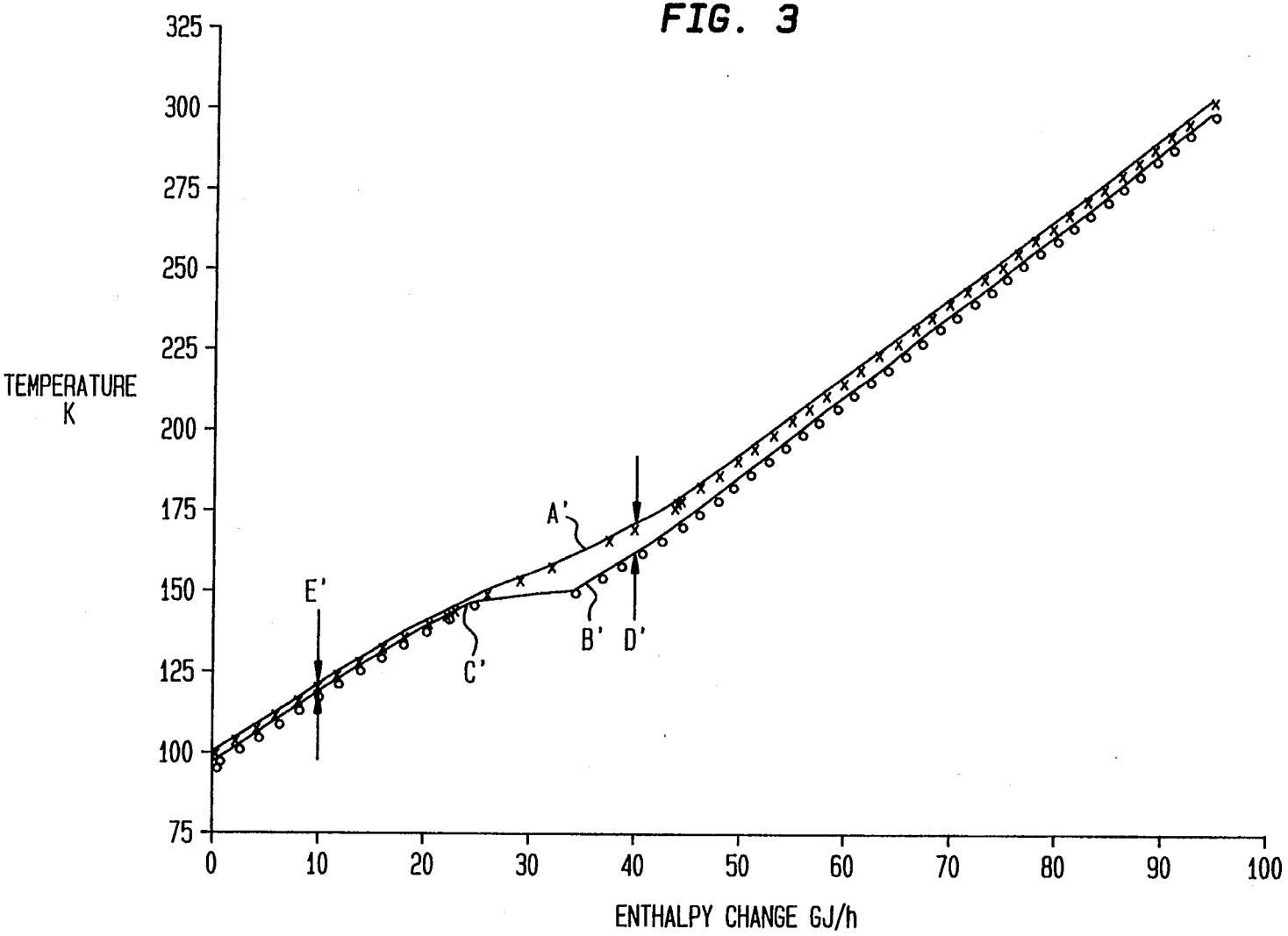
FIG. 3 is a graphs of temperature versus enthalpy of a heat exchanger constructed and operated in accordance with the present invention.

With reference to FIG. 3, the temperature-enthalpy characteristics of main heat exchanger 24 are plotted. It is to be noted that the pinch point temperature of the heat exchanger of FIG. 2 is the theoretical pinch point temperature of heat exchanger 24 for reasons discussed above. It is immediately apparent that the curves coincide more closely than in FIG. 2. It is to be noted that the pinch point temperature differences are the same (1.6° C.) in both cases. Curve A′ is the composite of all the streams to be cooled, for instance, further compressed air stream 20 passing through passageway 26, third subsidiary air stream 44 passing through passageway 48. Curve B′ is the sum of the temperature enthalpy characteristics at any point within the main heat exchanger of all the streams to be warmed, namely oxygen stream 94 passing through passage 28 and the waste nitrogen stream 92 passing though passageway 60. In main heat exchanger 24 (at the same points considered for the main heat exchanger of FIG. 2) the temperature difference at point D′, warmer than the theoretical pinch point temperature C′, and the temperature difference at level E′, at a temperature colder than the theoretical pinch point temperature C′, it can be seen that the temperature differences within main heat exchanger 24 are much less than a prior an heat exchanger used in delivering a pressurized oxygen product. As a result, less energy is supplied to high pressure compressor 18 than an equivalent compressor of the prior art to accomplish the same rate of vaporization of the pumped oxygen stream to be extracted from main heat exchanger 24 as a product. Maintaining close temperature differences is more important as the temperature of heat transfer decreases.

Returning to an explanation of the attached cycle, alter the air streams are cooled, they are rectified in an air separation unit 62 which is provided with a high pressure column 64 and low pressure column 66 operatively associated in a heat transfer relationship with one another by a condenser-reboiler 68. Incoming air is cooled to a temperature suitable for its rectification, namely at or near its dew point, and is introduced into the high column so that an oxygen-rich liquid forms as a column bottom and a nitrogen-rich tower overhead forms which is condensed by condenser-reboiler 68 to provide reflux for both the high and low pressure columns, against the vaporization of liquid oxygen collecting in the column bottom in low pressure column 66. Low pressure column 66 produces a nitrogen vapor tower overhead.

First subsidiary air stream 36 after having been fully cooled is introduced into a heat exchanger 70 located within the bottom of high pressure column 64 where it is further cooled. First subsidiary air stream 36 is then reduced in pressure to that of high pressure column 64 by provision of a Joule-Thompson valve 72 and is thereafter introduced into high pressure column to 64 for rectification. Heat exchanger 70 cools the air against vaporizing an oxygen-rich liquid column bottom that collects in high pressure column 64 to provide additional boil-up for high pressure column 64.

Second subsidiary air stream 32 after having been expanded by expander 38 is combined with fully cooled third subsidiary air stream 44 and is introduced into the bottom of high pressure column 64 for rectification. Fourth subsidiary air stream 46 alter having been fully cooled within fifth passageway 58 of main heat exchanger 24 is introduced into low pressure column 66 for rectification.

Air separation unit 62 operates in the manner of a conventional double column. High pressure column 64 is provided with contacting elements, for instance, structured packing, trays, random packing and etc. designated by reference numeral 74. Low pressure column 66 is provided with such contacting elements, designated for the low pressure column 66 by reference numeral 76. Within each column, an ascending vapor phase becomes richer in the more volatile component, nitrogen, as it ascends within the column. A liquid phase, as it descends with the column, becomes more concentrated in the less volatile component, oxygen. Contacting elements 74 and 76 bring these two phases into intimate contact in order to effect the distillation.

The oxygen-enriched column bottoms of high pressure column 78 is withdrawn as a crude oxygen stream 78. Crude oxygen stream 78 is subcooled within subcooler 80 and is reduced in pressure by provision of a Joule-Thompson valve 82 to low pressure column pressure of low pressure column 66 prior to its introduction into low pressure column 66. The condensed nitrogen-rich tower overhead of high pressure column 64 is divided into two streams 84 and 86 which are used to reflux high pressure column 64 and low pressure column 66, respectively. Stream 86 is also subcooled in subcooler 80, reduced in pressure to that of low pressure column 66 by a Joule-Thompson valve 87 and introduced into the top of low pressure column 66. A reflux stream 88 having a composition near that of liquid air is withdrawn from high pressure column 64 and passed through subcooler 80. This reflux stream is then passed through a Joule-Thompson valve 90 to reduce its pressure prior to its introduction into low pressure column 66. This reflux stream 88 serves the purpose of optimizing the reflux conditions within high and low pressure columns 64 and 66. Waste nitrogen composed of the nitrogen vapor tower overhead produced within low pressure column 66 is removed as a waste nitrogen stream 92. Waste nitrogen stream 92 is partially warmed within subcooler 80 and is then introduced into sixth passageway 60. It then can be expelled from the plant but, as illustrated, is supplied to purification unit 16 for regeneration purposes.

The oxygen product is provided by removing a liquid oxygen stream 94 from low pressure column 66 and pumping it by a pump 96 to the delivery pressure. Pump 96 is connected to second passageway 28 where oxygen within such pumped liquid oxygen stream vaporizes to produce the pressurized gaseous oxygen product.

EXAMPLE

In the following calculated example, 1067.7 $Nm^3$/min of oxygen product (about 95% purity) is produced at a pressure of approximately 42.6 bar(a). The details of operation of high and low pressure columns are conventional and as such are not set forth herein. It is to be noted though, that pumped oxygen stream 94 enters main heat exchanger 24 at a pressure of about 42.8 bar(a) and a temperature of about −177.8° C. after having been pumped from a pressure of 1.43 bar and a temperature of about −180.1 ° C. Waste nitrogen stream 92 at a flow rate of about 3772.5 $Nm^3$/min enters main heat exchanger at a temperature of −175.6° C.

| Stream | Flow ($Nm^3$/min) | Temp (°C.) | Pressure (bara) |
|---|---|---|---|
| Compressed air stream 13 after | 4840.3 | 29.4 | 5.52 |

-continued

| Stream | Flow ($Nm^3$/min) | Temp (°C.) | Pressure (bara) |
|---|---|---|---|
| air pre-purification unit 16 | | | |
| Further compressed air stream 20 after second after-cooler 22 | 1905.9 | 29.4 | 44.83 |
| First subsidiary air stream before heat pump compressor 34 | 1380.1 | −123.3 | 44.6 |
| Still further compressed stream 36 after introduction into main heat exchanger 24 and just prior to entering second section 26b of first passageway 26 | 1380.1 | −96.6 | 74.6 |
| Still further compressed stream 36 after full cooling in main heat exchanger 24 | 1380.1 | −173.3 | 74.5 |
| Second subsidiary stream 32 prior to expander 38 | 525.8 | −94.3 | 44.8 |
| Second subsidiary stream 32 after expansion in expander 38 | 525.8 | −172.8 | 5.38 |
| Third subsidiary air stream 44 after cooling within main heat exchanger 24 | 2540.1 | −173.3 | 5.45 |
| Fourth subsidiary air stream 46 after refrigeration booster compressor 50 and after-cooler 52 | 394.3 | 29.4 | 8.78 |
| Fourth subsidiary air stream 46 after partial cooling within main heat exchanger 24 | 394.3 | −95.6 | 8.64 |
| Fourth subsidiary air stream 46 after refrigeration turboexpander 56 | 394.3 | −156.7 | 1.50 |
| Fourth subsidiary air stream 46 after passage through main heat exchanger 24 | 394.3 | −173.3 | 1.45 |

In order to effect the same oxygen production by prior art method and apparatus, it has been calculated that a compressed air stream functioning as further compressed air stream 20 to vaporize the liquid oxygen would have to be compressed to a pressure of about 74.48 bar(a) and a flow of 1761.3 $Nm^3$/min.

Although the process and apparatus of the present invention has been illustrated with respect to a double column air separation column, it is understood that proper cases path single column oxygen generators are possible. Additionally, as mentioned above, the present invention could be used with any low temperature rectification process in which a pumped liquid product is vaporized in main heat exchanger.

Furthermore, although first and second subsidiary streams 30 and 32 are removed from separate points in main heat exchanger 24, it is possible, in a proper case, to remove them from the same temperature level. Moreover, although second subsidiary stream 32 is formed from part of further compressed air stream 20, it could also be formed from another air stream being cooled within main heat exchanger 24 or in case of an application other than air separation, some other process stream containing the gaseous mixture and being cooled within the main heat exchanger.

As will further be understood by those skilled in the art, although the invention has been described with reference to a preferred embodiment, as will occur to those skilled in the art numerous changes and omissions can be made without departing from the spirit and scope of the present invention.

I claim:

1. A process for separating air and thereby producing a gaseous oxygen product at a delivery pressure, said process comprising:

compressing the air, removing heat of compression from the air, and purifying the air;

cooling the air in a main heat exchanger;

prior to the cooling of the air, further compressing at least a portion of the air to be cooled to form a further compressed air stream and removing heat of compression from the further compressed air stream;

removing at least part of the further compressed air stream from the main heat exchanger at a location of the main heat exchanger at which said further compressed stream has a temperature in the vicinity of a theoretical pinch point temperature determined for the main heat exchanger, still further compressing at least a portion of said at least part of the further compressed air stream removed from the main heat exchanger to form a first subsidiary air stream, and introducing said first subsidiary air stream back into the main heat exchanger at a level thereof having a warmer temperature than said theoretical pinch point temperature;

after reintroduction into the main heat exchanger, fully cooling said first subsidiary air stream to a temperature suitable for its rectification;

removing part of the air to be cooled from the main heat exchanger to form a second subsidiary air stream and cooling said subsidiary air stream to a temperature suitable for its rectification without the use of the main heat exchanger;

the second subsidiary air stream being cooled by expanding said second subsidiary air stream with the performance of expansion work;

applying at least part of the work of expansion to the further compression of said at least portion of the at least part of the further compressed air stream removed from the main heat exchanger;

rectifying the air in the first and second subsidiary air streams within an air separation unit configured such that liquid oxygen is produced;

supplying refrigeration to the process to maintain energy balance of the process; and removing a liquid oxygen stream from the air separation unit composed essentially of the liquid oxygen, pumping the liquid oxygen stream to the delivery pressure, vaporizing said liquid oxygen stream in the main heat exchanger such that it is fully warmed to ambient temperature, and extracting said liquid oxygen stream from the main heat exchanger as the gaseous oxygen product.

2. The process of claim 1, wherein:

all of further compressed air stream is removed from said main heat exchanger;

said part of the air to be cooled that is removed from the main heat exchanger and is subsequently expanded comprises part of the further compressed air stream removed from the main heat exchanger; and said at least a portion of the at least part of the further compressed air stream removed from the main heat exchanger subjected to still further compression comprises a remaining part of the further compressed air stream removed from the main heat exchanger.

3. The process of claim 1, wherein:

the air separation unit comprises a double column having high and low pressure columns connected to one another in a heat transfer relationship such that the a liquid oxygen column bottom and a nitrogen vapor tower overhead are produced in the low pressure column, an oxygen enriched liquid column bottom and a nitrogen rich vapor tower overhead are produced in the high pressure column, and the liquid oxygen column bottom vaporizes against condensing the nitrogen rich vapor tower overhead to produce a nitrogen rich liquid tower overhead in the high pressure column;

a crude liquid oxygen stream and a nitrogen rich liquid stream composed of the oxygen rich liquid column bottom and the nitrogen rich liquid tower overhead, respectively, are withdrawn from the high pressure column, subcooled, and reduced in pressure to low pressure column pressure;

the crude liquid oxygen stream is introduced into the low pressure column for further refinement and the nitrogen rich liquid stream is introduced into the low pressure column as reflux;

the liquid oxygen stream is withdrawn from the low pressure column; and a nitrogen vapor stream composed of the nitrogen vapor tower overhead is removed from the low pressure column, is partially warmed through heat exchange with the crude liquid oxygen stream and the nitrogen rich liquid stream to thereby subcool the crude liquid oxygen and nitrogen rich liquid streams, and is then introduced into the main heat exchanger and is fully warmed therein.

4. The process of claim 3, wherein:

after the air is purified, it is divided into first and second partial streams;

the portion of the air to be cooled and further compressed comprises the first partial stream;

substantially all of the further compressed air stream is removed from said main heat exchanger;

said part of the air to be cooled and subsequently expanded that is removed from the main heat exchanger comprises part of the further compressed air stream removed from the main heat exchanger;

said at least a portion of the part of the further compressed air stream removed from the main heat exchanger subjected to further compression comprises a remaining part of the further compressed air stream removed from the main heat exchanger the second partial stream is divided into third and fourth subsidiary air streams;

the third subsidiary airstream is fully cooled within the main heat exchanger;

the fourth subsidiary air stream is further compressed, heat of compression is removed from the fourth subsidiary stream, the fourth subsidiary stream is thereafter subjected to expansion with the performance of work and is further cooled within the main heat exchanger;

the first subsidiary stream is subdivided into fifth and sixth subsidiary air streams after having been fully cooled, the second and fifth subsidiary air streams are introduced into the high pressure column and the sixth subsidiary air stream is subcooled against the partial heating of the nitrogen vapor stream, is reduced in pressure to the low pressure column pressure and is introduced into the low pressure column; and the fourth subsidiary air stream is introduced into the low pressure column.

5. A process for vaporizing a lower volatility product pumped to a delivery pressure after having been separated from a higher volatility product of a compressed gaseous mixture by a cryogenic rectification process utilizing a main heat exchanger configured to cool the compressed gaseous mixture to a temperature suitable for its rectification, said process comprising:

prior to the cooling of the compressed gaseous mixture, further compressing at least a portion of the compressed gaseous mixture to be cooled to form a further compressed stream and removing heat of compression from the further compressed stream;

removing at least a portion of the further compressed stream from the main heat exchanger at a location of the main heat exchanger at which the further compressed stream has a temperature in the vicinity of a theoretical pinch point temperature, still further compressing at least part of the at least a portion of the further compressed stream removed from the main heat exchanger to form a first subsidiary stream, and introducing said first subsidiary air stream back into the main heat exchanger at a level thereof having a warmer temperature than the theoretical pinch point temperature;

after reintroduction into the main heat exchanger, fully cooling said first subsidiary stream to a temperature suitable for its rectification;

removing part of the compresses gaseous mixture to be cooled from the main heat exchanger to form a second subsidiary stream and cooling said second subsidiary stream to the temperature suitable for its rectification without the further use of the main heat exchanger;

the second subsidiary stream being cooled by expanding said second subsidiary stream with the performance of expansion work such that its temperature after expansion is at the temperature suitable for its rectification;

applying at least part of the work of expansion to the further compression of the at least a portion of the at least part of the further compressed stream; and vaporizing the lower volatility product within the main heat exchanger.

6. An apparatus for producing an oxygen product at a delivery pressure from air, said apparatus comprising:

a main compressor for compressing the air;

a first after-cooler connected to the compressor for removing heat of compression from the air;

air pre-purification means connected to the first after-cooler for purifying the air;

a high pressure air compressor connected to the air pre-purification means for further compressing at least a portion of the air to form a further compressed air stream;

a second after-cooler connected to the booster compressor for removing heat of compression from the further compressed air stream;

a main heat exchanger having a first passageway including first and second sections, the first section in communication with said second after-cooler such that said compressed air stream flows into said first section of the first passageway, a second passageway, means for discharging first and second subsidiary air streams composed of the compressed air stream from the first section of the first passageway so that at least the first subsidiary air stream upon discharge has a temperature in the vicinity of a theoretical pinch point temperature determined for the main heat exchanger, and an inlet situated at a location of the main heat exchanger having a warmer temperature than the theoretical pinch point temperature for receiving the first subsidiary air stream after compression thereof, the second section of the first passageway in communication with the inlet and positioned such that the first subsidiary air stream fully cools;

a heat pump compressor connected between the discharge means of the main heat exchanger and the inlet thereof for compressing the first subsidiary air stream;

expansion means for expanding the second subsidiary air stream with the performance of expansion work;

the expansion means coupled to the heat pump compressor such that at least part of the expansion work drives the heat pump compressor;

air rectification means connected to the expansion means and the second section of the first passageway of the main heat exchanger for rectifying the air and thereby producing liquid oxygen;

a pump connected to the air rectification means for pumping the liquid oxygen and thereby forming a pumped liquid oxygen stream;

the pump connected to the second passageway of the main heat exchanger such that the pumped liquid oxygen stream flows in a counter-current direction to the compressed air stream within the first passageway and is thereby vaporized to produce the gaseous oxygen product; and refrigeration means for supplying refrigeration to the apparatus such that energy balance thereof is maintained.

* * * * *